United States Patent [19]

McIntyre

[11] Patent Number: 4,766,957

[45] Date of Patent: Aug. 30, 1988

[54] METHOD AND APPARATUS FOR REMOVING EXCESS WATER FROM SUBTERRANEAN WELLS

[76] Inventor: Jack W. McIntyre, 107 N. Overland Ave., Fort Stockton, Tex. 79735

[21] Appl. No.: 78,804

[22] Filed: Jul. 28, 1987

[51] Int. Cl.[4] ..... E21B 43/38; E21B 43/40

[52] U.S. Cl. ..... 166/265; 166/306; 166/387; 166/106; 166/378; 166/66.4; 166/53

[58] Field of Search ..... 166/265, 306, 311, 369, 166/378, 106, 105.5, 66.4, 387, 53; 405/53

[56] References Cited

U.S. PATENT DOCUMENTS

| | | | |
|---|---|---|---|
| 2,214,064 | 9/1940 | Niles | 166/54 |
| 2,986,215 | 5/1961 | Barr | 166/54 |
| 3,167,125 | 1/1965 | Bryan | 166/306 |
| 3,195,633 | 7/1965 | Jacob | 166/306 |
| 3,199,592 | 8/1965 | Jacob | 166/306 |
| 3,333,638 | 8/1967 | Bishop | 166/306 |
| 3,363,692 | 1/1968 | Bishop | 166/306 |
| 4,241,787 | 12/1980 | Price | 166/265 |
| 4,296,810 | 10/1981 | Price | 166/265 |

*Primary Examiner*—Jerome Massie, IV
*Assistant Examiner*—Bruce M. Kisliuk
*Attorney, Agent, or Firm*—Thomas E. Sisson

[57] ABSTRACT

A method and apparatus for effecting the gravitational separation of hydrocarbons and water discharged from a production formation of a subterranean well. The well casing is extended downwardly beyond the production zone to a water absorbing zone of the subterranean well. A mixture of hydrocarbons and water flows into the interior of the casing through perforations disposed adjacent the production zone. A fluid collection chamber is provided either exteriorly or interiorly of the casing perforations permitting the hydrocarbons to rise to the top of any water. The water flows downwardly, or is forcibly pumped downwardly to the water absorbing formation and is absorbed in such formation. If the fluid pressure of the formation is not sufficient to force the hydrocarbons to the surface of the well, any conventional pump may be mounted in the well casing to effect the pumping of the separated hydrocarbons to the well surface.

8 Claims, 3 Drawing Sheets

METHOD AND APPARATUS FOR REMOVING EXCESS WATER FROM SUBTERRANEAN WELLS

BACKGROUND OF THE INVENTION

1. Field of the Invention

The invention relates to the separation of water from hydrocarbons produced by a production zone of a subterranean well and the disposal of such separated water by directing the water downwardly to a water absorbing formation.

2. Summary of the Prior Art

The operation of hydrocarbon producing wells, and particularly gas wells, has been plagued with the accumulation of liquids, primarily water, in the well bore. Liquid accumulation can occur in wells that have never produced large quantities of liquid. When the velocity of the produced fluid in the tubing is too low to lift the liquids to the surface, the liquid accumulates and begins to buildup in the bottom of the well. The increased hydrostatic head acting on the formation further reduces the flow rate and thus the velocity of the produced fluids. This process continues until the well dies or begins to flow intermittently. The source of these liquids is either condensation of water from the gas, or water entering from the formation. Various methods for removing liquids from gas wells, sometimes called dewatering have been used in the past. Prior art methods for liquid removal include pumping units, gas lift, plunger lift, intermittent flow with flow controllers, small tubing installation, and soap injection.

All of these prior art efforts to solve the liquid accumulation problem in subterranean wells have concentrated on elevating the excess liquid to the surface. The prior art has not recognized that effective removal of liquid from hydrocarbon wells, and particularly gas wells, can be accomplished by transferring the accumulated liquids downwardly to a water absorbing formation isolated from the production formation.

SUMMARY OF THE INVENTION

The primary object of this invention is to effect the removal of undesirable liquids, primarily water, from hydrocarbon producing wells wells, and particularly gas wells, by the transfer of excess accumulations of liquid downwardly to a liquid absorbing formation which is isolated from the production formation. This basic method may be accomplished by the use of a variety of conventional well equipment, but fundamental to the accomplishment of the method, is the recognition that the well bore should be extended downwardly from the lowermost production formation to the vicinity of a water absorbing formation, and similarly, the casing, if the well is cased, should be extended to the water absorbing formation. The casing wall is, of course, perforated in the region adjacent the production formation. The casing may also traverse the water absorbing formation and be perforated adjacent such formation. Alternatively, the casing may terminate immediately adjacent to the water absorbing formation, depending upon the rate of water absorption provided by the particular formation.

In one modification of the invention, the well bore is under reamed adjacent the production formation to create a fluid collection chamber having a height at least equal to that of the production formation. Separation by gravity of the hydrocarbons from the liquids, primarily water, flowing from the production formation then occurs in the under reamed chamber. Both the liquid and the gases and the hydrocarbons enter the interior of the casing through the conventional perforations, but the hydrocarbons, particularly gases, because of their lighter density, move upwardly while the water, moves downwardly, and thus flows through the casing down to the water absorbing zone, so that any substantial accumulation of excess liquids in the production zone is avoided.

In other modifications of this invention, a pump is mounted within the casing with an intake port disposed at a level below the casing perforations that are adjacent to the production zone. Such pump is then piped to forcibly direct a stream of liquid downwardly to the water absorbent formation.

According to the characteristics of a particular well, the necessary apparatus may involve either two packers, respectively disposed above and below the production formation or a single packer mounted on the bottom end of a tool string which is located substantially below the production perforations so as to define an annular fluid collection chamber of substantial vertical extent.

The tool string utilized in the last mentioned modification includes a motor driven pump which has a radially disposed intake communicating with the casing annulus at a point representing the maximum height desired for liquid in the annular collection chamber. The output of the pump is connected by a separate conduit to a radial port provided in a tubular portion of the tool string above the packer which sealingly passes through the bore of the packer. The liquid is thus pumped downwardly through the packer and forced into the water absorbent formation. If desired, a check valve may be mounted in the lower tubular portion of the tool string to prevent upward flow of liquids from the water absorbing formation.

While not limited thereto, an electric motor is preferred to drive the pump so that a conventional fluid level responsive switch can be incorporated in the electric line running from the surface to the pump motor and located at a level corresponding to the maximum level desired for liquids in the annular collection chamber. Thus, continuous operation of the pump is not required.

The advantages of the invention will be readily apparent to those skilled in the art in that the downward disposal of the surplus liquids from a production zone avoids the harrassing environmental problems associated with bringing the excess liquids to the surface and properly disposing of same. Moreover, such downward disposal can be accomplished by the assembly of conventional well equipment units and without requiring separate conduits to be run into the well for effecting the removal of the surplus liquid.

Further advantages of the invention will be readily apparent to those skilled in the art from the following detailed description, taken in conjunction with the annexed sheets of drawings, on which are shown several preferred embodiments of the invention.

DESCRIPTION OF PREFERRED EMBODIMENTS

Figure 1:
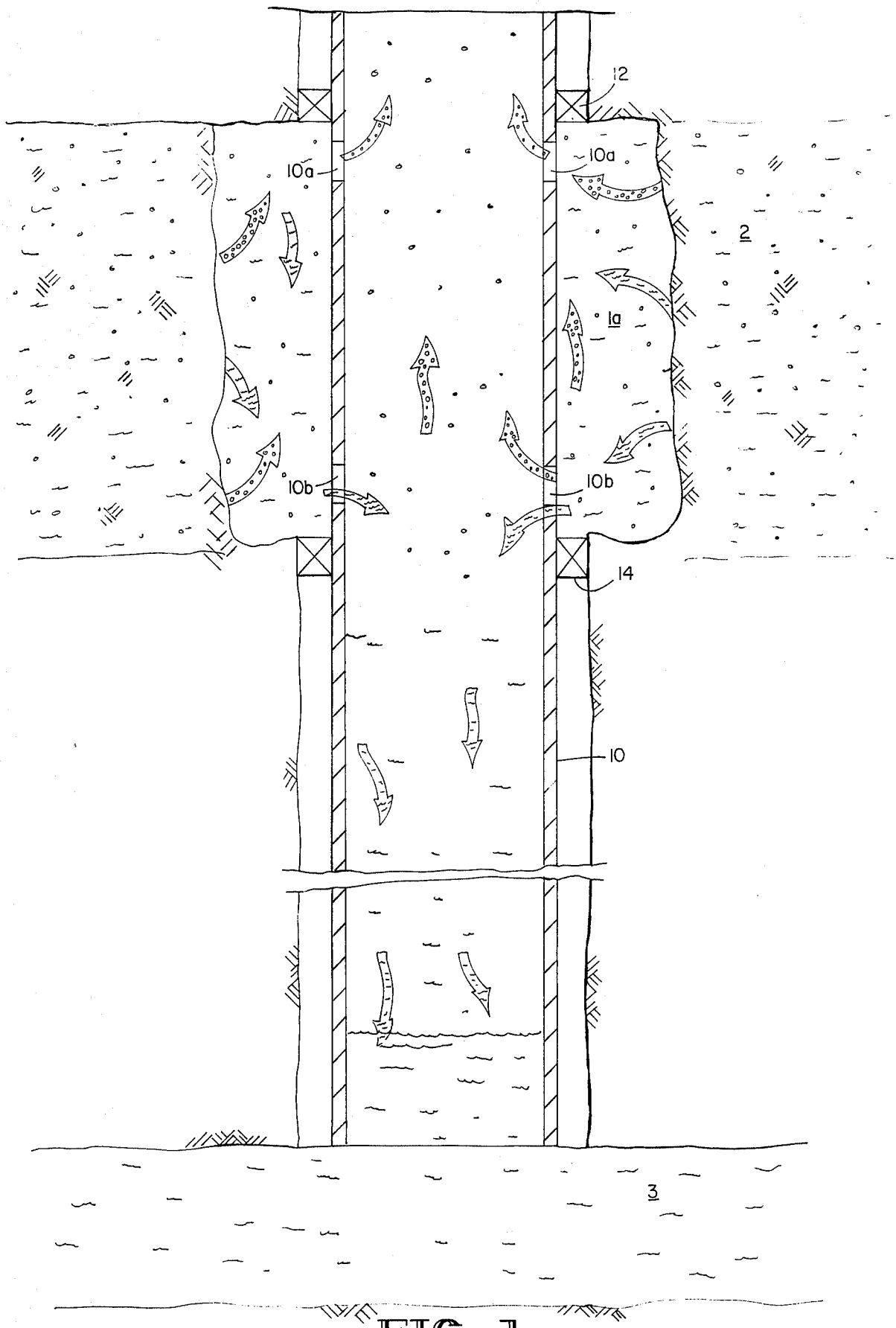
FIG. 1 is a schematic vertical sectional view of one form of apparatus for carrying out the method of this invention.

Referring to FIG. 1, a subterranean well bore 1 is shown traversing first a production formation 2 and then extending downwardly whatever distance is necessary to reach and traverse a water absorbing formation 3. A casing string 10 is run into the well in conventional fashion and has mounted on its exterior a pair of vertically spaced packers 12 and 14. Such packers are preferably of the well known inflatable type which are capable of achieving a seal with the well bore 1 and are inflated by fluid pressure supplied from the well surface in a manner that is well known in the art. Packer 12 is preferably disposed immediately adjacent the top of the production formation 2, while the lower packer unit 14 is disposed immediately adjacent the bottom end of the production formation 2 thereby isolating the production formation. Casing string 10 is provided with two vertically spaced sets of perforations 10*a* and 10*b*, the perforations 10*a* being located adjacent the top end of the production formation 2 and the perforations 10*b* being located adjacent the bottom end of the production formation 2.

Preferably, the well bore 1 is under reamed adjacent the production formation 2 to provide a collection chamber 1*a* which is substantially the same height as the production formation 2.

With this arrangement, it will be apparent that the mixture of hydrocarbons and liquids, primarily water, flowing out of the production formation 2 and into the collection chamber 1*a*, will be subject to gravitational separation so that the hydrocarbons, and particularly gas represented by the arrows with bubbles will primarily enter the perforations 10*a* and rise upwardly through the casing 10, while the higher density liquid, particularly water, represented by the other arrows, will primarily enter the casing 10 through the lower perforations 10*b* and flow downwardly through the casing 10 to the water absorbing formation 3 where it will be absorbed and dispersed without in any manner contaminating the production formation 2. This gravitational separation will occur where formation 3 is an underpressure formation.

Those skilled in the art will recognize that if the produced hydrocarbons do not have sufficient velocity to rise to the surface of the well, any form of conventional pump may be mounted within the bore of the casing 10 to effect the pumping of the produced hydrocarbons to the well surface. Such upward pumping apparatus is entirely conventional and forms no part of the instant invention.

Referring now to FIG. 2, a well bore 1 is again shown traversing both the production formation 2 and a water absorbing formation 3. A casing string 10 is provided which traverses both the producing formation 2 and the water absorbent formation 3. Cement 5 is pumped intermediate casing 10 and well bore 1 to isolate production zone 2. Casing 10 is provided with a plurality of vertically spaced perforations 10*c* adjacent the producing formation 2 and a plurality of vertically spaced perforations 10*d* adjacent the water absorbing formation 3.

A tool string 20 is assembled on the end of a tubular string 15 which extends to the surface of the well. The tool string 20 comprises, from the bottom up, a lower tubular portion 22 which sealingly extends through the bore of an annular lower packer 24. If desired, a check valve 25 may be conventionally mounted in or secured to the bottom end of tubular portion 22 to prevent upward flow of fluid from the water absorbing formation 3.

Immediately above the lower packer 24, an entry port 26 is provided on the top end of the tubular portion 22. Entry port 26 provides a radially disposed port for receiving liquids pumped downwardly by the apparatus disposed above such port, as will be described. A blanking plug 28 is mounted immediately above the entry port 26 and a motor driven pump 30 is conventionally mounted above the blanking plug 28. The motor driven pump 30 comprises a conventional pump unit 30*a* driven by a motor 30*b* which may be powered either by fluid pressure supplied through a control pipe (not shown) or by electricity supplied through an electric line (not shown). The pump unit 30*a* has a radially disposed intake port 30*c* which is in communication with the casing annulus. The discharge port of the pump 30*a* is here shown as a hollow tubular element 32 to which is secured a conduit 34 extending downwardly to the radial inlet port 26.

A blanking plug 36 is then mounted in the tubular element 32 and a perforated nipple 38 is secured above the blanking plug 36 and effects communication with the lower end of tubing string 15 which projects through the bore of a conventional upper packer unit 40.

When the aforedescribed tool string 20 is assembled, it is run into the well on the bottom end of the tubing string 15 in conventional fashion until the radial inlet port 30*c* is disposed at a desired level below the production formation 2 corresponding to the maximum height of the collected fluid in the casing annulus 10*a* desired for the particular well. The upper and lower packers 40 and 24 are then set. In this position, the perforations 38*a* provided in the perforated nipple 38 are disposed adjacent the production formation 2 and preferably slightly above such production formation.

Figure 2:
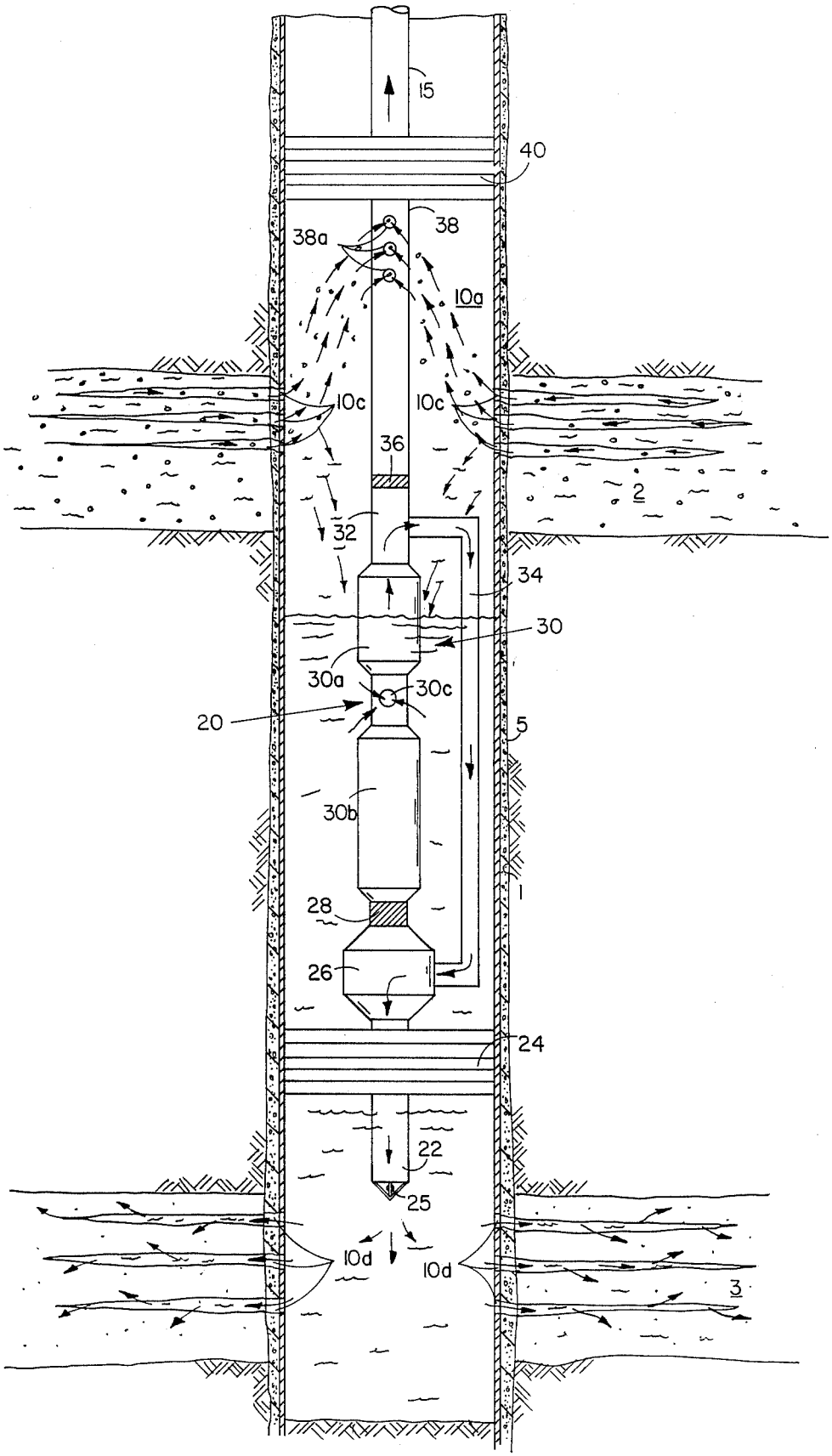
FIG. 2 is a schematic vertical sectional view of a second form of apparatus for carrying out the method of this invention.

The operation of the modification of FIG. 2 will be readily apparent to those skilled in the art. The produced hydrocarbons along with drops of water will enter the casing annulus 10*a* through the casing perforations 10*c*. Gravity will effect the downward displacement of the water droplets to collect in the annular collection chamber defined by the casing annulus 10*a* above the lower packer 24. When the level of such collected fluid reaches or passes the location of the pump inlet port 30*c*, the motor driven pump 30 will be activated to remove any excess accumulation of liquid from the casing annulus and pump such liquid downwardly through the conduit 34 and thence into the inlet port 26 and through the packer 24 by passing through the bore of tubular portion 22 which sealingly traverses the bore of the lower packer 24. Thus, the excess liquids will be forcibly injected into the water absorbing formation 3. Check valve 25 prevents any upward flow of fluids from the water absorbing formation 3.

If desired, the production formation adjacent the casing perforations 10*c* may be under reamed in manner illustrated in FIG. 1.

In the modification of FIG. 2, the produced hydrocarbons will flow into the bore of the tubing string 15 through the perforations 38*a* of the perforated nipple 38. Again, if the flow velocity is insufficient to cause the hydrocarbons to rise to the surface, any suitable upwardly directed pump may be incorporated in the tubing string 15 to facilitate the flow of such hydrocarbons to the surface.

The upper and lower packers 24 and 40 comprise conventional units, a variety of which are currently available. Such packers may be either mechanically set by manipulation of the tubing string or set through the application of fluid pressure, or one may be mechanically set and the other set by fluid pressure. In any event, the details of such packers are entirely conventional.

Figure 3:
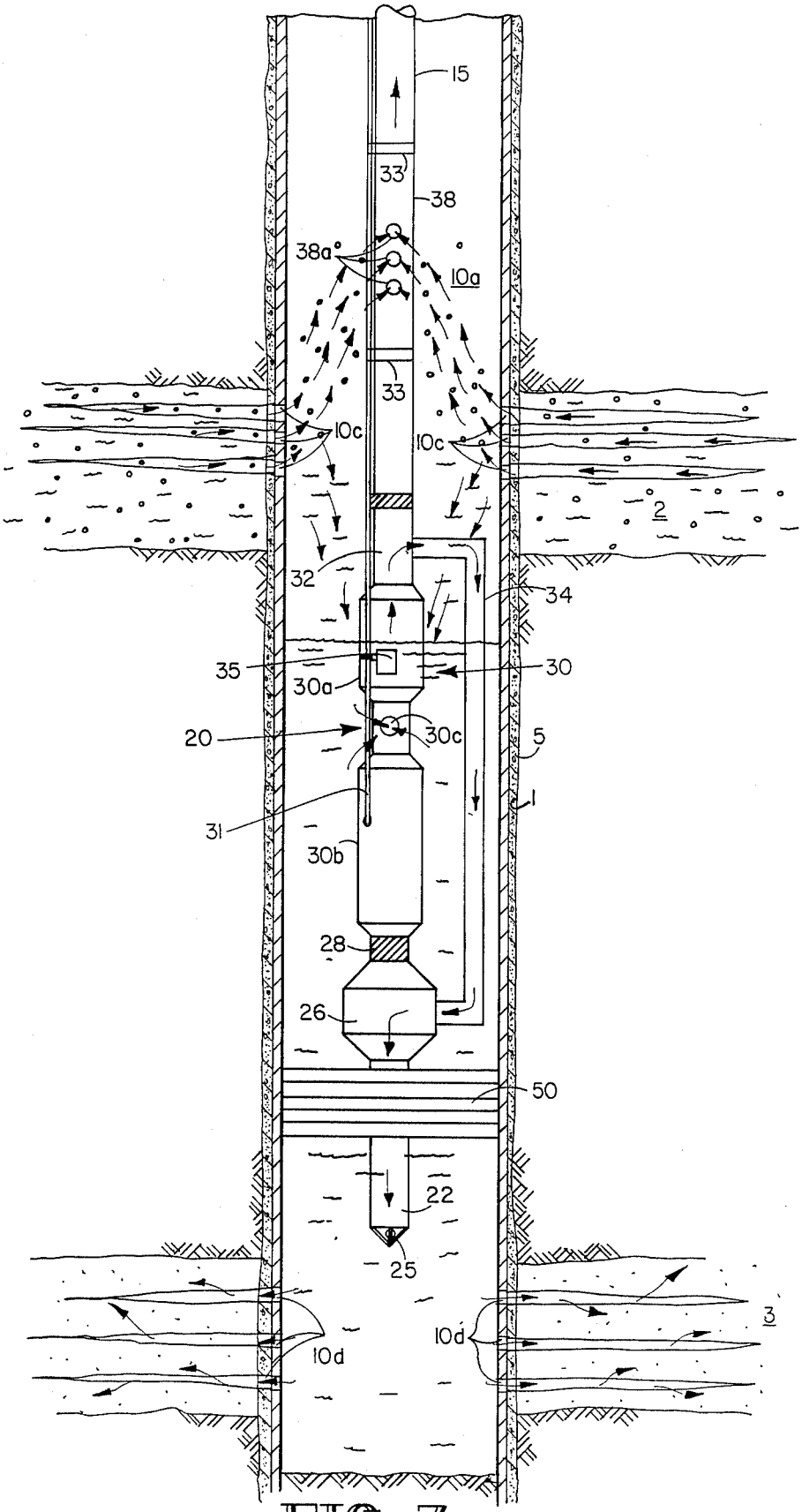
FIG. 3 is a schematic vertical sectional view of a third form of apparatus for carrying out the method of this invention.

Referring now to FIG. 3, there is shown a third modification of this invention wherein only a single packer unit 50 is employed. As before the casing string 10 traverses the production zone 2 and extends downwardly to traverse the water absorbing formation 3. Cement 5 isolates the production formation 2. Perforations 10*c* are provided in the casing 10 adjacent the production zone 2 and perforations 10*d* adjacent the water absorbing formation 3. A packer 50 is set by wireline in the casing 10 at a position substantially below the production formation 2. Packer 50 is of the type that defines an upwardly open receptacle (not shown) for sealably receiving the bottom tubular end or mandrel portion 22 of the tool string 20 which has been previously described in detail in connection with FIG. 2. FIG. 3 also shows the position of an electric wire 31 which is secured to the tool string 20 by clamps 33 to provide energizing power for the motor 30*b* which is, in this instance, an electric motor. The electric wire 31 passes through a fluid level responsive electric switch 35 which is disposed on the tool string 20 at an elevation corresponding to the desired maximum height of fluid to be collected in the annular collection chamber 1*a*. Thus, whenever the collected fluids reach the fluid level responsive switch 31, the motor 30*b* is energized to drive the pump 30*a* and pump the excess fluid downwardly through the lower packer 50 and into the water absorbing zone 3.

Those skilled in the art will recognize that the mounting of the motor driven pump 30 shown in the modifications of FIGS. 2 and 3 on the bottom end of a tubing string is not the only known method of supporting such pump within a well casing. The motor driven pump 30 and its connecting conduit 34 could be run in by wireline and the bottom tubular mandrel portion 22 of the tool assembly stabbed into the receptacle of the packer 50 for supporting the pump within the well casing. Otherwise, the operation of the pump would be identical to that previously described.

Those skilled in the art will further recognize that the method of hydrocarbon production utilizing this invention constitutes the separation of the hydrocarbons from the undesirable liquids, namely water, in the well bore immediately adjacent the production area of the well. The water is left in the well and the oil or gas allowed to flow or to be pumped upwardly to the well surface in a conventional manner. The method of this invention will obviously eliminate the upward pumping of water from subterranean wells with its attendant cost of disposal. More importantly, it will increase oil or gas production substantially with considerably less surface equipment. Watered up wells that have stopped producing or are not economically producing could be produced at an economic level because there is no water to handle on the surface.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. The method of removing water from a subterranean hydrocarbon formation comprising the steps of:

drilling a well through the hydrocarbon producing formation and downwardly to a water absorbing formation;

running a casing string into the well through the hydrocarbon formation and downwardly to the water absorbing formation;

perforating the casing at a plurality of vertically spaced locations adjacent said hydrocarbon producing formation;

assembling a tool string including from the bottom up a tubular portion including a one-way flow valve, a tubing inlet port, a first blanking plug, a lower packer sealingly secured to said tubular portion; a fluid pump having a casing-tubing annulus intake and an output port, a pump output conduit communicating between the pump output and the tubing inlet port, a second blanking plug, a perforated nipple, and an upper packer spaced above the second blanking plug and above said casing perforations;

running the assembled tool string into the well to position the lower packer below said casing perforations and said upper packer above said casing perforations;

setting said packers; and operating said pump to force fluid in the casing annulus below said casing perforations downwardly through said lower packer and said one-way flow valve to said water absorbing formation.

2. The method of removing water from a hydrocarbon producing formation of a subterranean well traversed by a perforated casing comprising the steps of:

extending the casing downwardly to a water absorbing formation;

setting a packer having a stab-in tubing receptacle at a location in the casing below the casing perforations communicating with the hydrocarbon producing formation;

assembling a tool string comprising from the bottom up, a stab-in mandrel, a one-way flow valve, a radial tubing inlet port, a fluid pump having an inlet port communicating with the casing-tubing annulus and an outlet port, a conduit communicating between said pump outlet port and said tubing inlet port;

running the assembled tool string into the well casing and sealingly engaging said stab-in mandrel in said packer receptacle; and operating said pump to remove fluid existing in said casing below said casing perforations and force said fluid downwardly through said one-way flow valve into said water absorbing formation.

3. The method of removing water from a subterranean hydrocarbon formation comprising the steps of:

drilling a well through the hydrocarbon producing formation and downwardly to a water absorbing formation;

running a casing string into the well through the hydrocarbon formation and downwardly to the water absorbing formation;

perforating the casing at a plurality of vertically spaced locations adjacent said hydrocarbon producing formation;

assembling a tool string including from the bottom up an annular packer, a tubular portion sealingly inserted in the annular packer, a tubing inlet port, a first blanking plug, a fluid pump having an intake communicable with the tubing-casing annulus, a pump output conduit communicating between the pump output and the tubing inlet port, a second blanking plug, and a perforated nipple connected to the bottom of a tubing string;

running said tool string into the well and setting said packer to position said packer below said casing perforations and said perforated nipple adjacent said casing perforations; and operating said pump to force fluid in the tubing-casing annulus below said casing perforations downwardly through said packer and said one-way flow valve to said water absorbing formation.

4. The method of claim 1, 2, or 3 wherein said pump is driven by an electric motor and further comprising the step of running an electric line to said motor through a fluid level switch positioned below said casing perforations.

5. Apparatus for removing water produced concurrently with hydrocarbons from a production formation traversed by a subterranean well comprising a casing string extending from the surface through the production formation and downwardly to a water absorbing formation; said casing having perforations adjacent the production formation; a tubular packer set in said casing string at a location below said perforations, a tool string having a lower tubular portion sealably inserted in a bore of said tubular packer, thereby defining a water collecting annulus extending upwardly from said tubular packer to said casing perforations; said tool string comprising, from the bottom up: an inlet port in said tubular portion disposed above said tubular packer; a blanking plug in said tubular portion; a motor driven pump; said pump having a radial fluid inlet communicating with said water collecting annulus at a region below said perforations; said pump having a fluid outlet; and conduit means connecting said pump fluid outlet to said inlet port, whereby water in said water collecting annulus is forcibly pumped through said tubular packer and into the water absorbing formation.

6. The apparatus of claim 5 further comprising a blanking plug in said tool string above said motor driven pump; a perforated nipple above said blanking plug and above said casing perforations; and a tubing string extending from the perforated nipple to the surface for conducting produced hydrocarbons to the surface.

7. The apparatus of claim 5 or 6 wherein said motor driven pump comprises a submersible electric motor; an electric line attached to said tool string for supplying electrical power to said submersible electric motor; and a fluid level responsive electrical switch incorporated in said electric line at a location below said casing perforations, whereby said motor driven pump is operated only when the water level in said water collecting annulus reaches the level of said electrical switch.

8. The apparatus of claim 5 or 6 further comprising a check valve mounted in said lower tubular portion of said tool string to prevent upward flow of fluid into said tubular lower portion.

* * * * *